US007614843B2

(12) United States Patent
Hested et al.

(10) Patent No.: US 7,614,843 B2
(45) Date of Patent: Nov. 10, 2009

(54) FREELY ROTATABLE CLOSED GRAPPLE HEAD AND MACHINE USING SAME

(75) Inventors: Larry D. Hested, Geneva, IL (US); Timothy G. Sidles, Oswego, IL (US); Brian Marstall, Chesterfield, MO (US)

(73) Assignee: Caterpillar Inc., Peoria, IL (US)

( * ) Notice: Subject to any disclaimer, the term of this patent is extended or adjusted under 35 U.S.C. 154(b) by 279 days.

(21) Appl. No.: 11/650,376

(22) Filed: Jan. 5, 2007

(65) Prior Publication Data

US 2008/0166212 A1 Jul. 10, 2008

(51) Int. Cl.
*B66C 1/10* (2006.01)

(52) U.S. Cl. ..... 414/739; 414/729; 294/86.4; 294/104; 37/468

(58) Field of Classification Search ..... 414/729, 414/739, 723; 37/468; 294/86.4, 88, 104
See application file for complete search history.

(56) References Cited

U.S. PATENT DOCUMENTS 3,990,688 A 11/1976 Koch
4,239,273 A 12/1980 Dodemont et al.
4,315,652 A 2/1982 Barwise
4,396,215 A 8/1983 McCutcheon
4,431,365 A 2/1984 Sturtz, Jr.
4,502,723 A 3/1985 Kuromoto
4,529,239 A 7/1985 Ogawa
4,679,839 A 7/1987 Damron
5,018,935 A 5/1991 Gage
5,499,503 A 3/1996 Stoychoff
5,540,050 A 7/1996 Krupowicz

*Primary Examiner*—Donald Underwood
(74) *Attorney, Agent, or Firm*—Liell & McNeil

(57) ABSTRACT

A machine includes a chassis and a boom assembly. The boom assembly is movable relative to the chassis. The machine further includes a grapple assembly suspended from the boom assembly. The grapple assembly comprises a grapple head fluidly connected to a first hydraulic circuit for actuating the grapple head to a grasping configuration, and a hydraulic motor fluidly connected to a second hydraulic circuit for rotating the grapple head. The second hydraulic circuit includes a bypass valve. The bypass valve has a first position configured to block a fluid flow between a first port of the hydraulic motor and a second port of the hydraulic motor. The bypass valve also has a second position configured to allow a fluid flow between the first port of the hydraulic motor and the second port of the hydraulic motor. The bypass valve allows the grapple head to rotate freely when the grapple head is in a grasping configuration.

17 Claims, 3 Drawing Sheets

FREELY ROTATABLE CLOSED GRAPPLE HEAD AND MACHINE USING SAME

TECHNICAL FIELD

The present disclosure relates generally to a grapple assembly of a machine that includes a hydraulic motor for rotational movement of a grapple head, and more particularly to a strategy for allowing the grapple head to rotate freely when in a grasping configuration.

BACKGROUND

Grapple skidders are forestry work machines used to haul logs, typically over rugged terrain. A skidder includes a grapple assembly located at one end of the skidder to pick up, haul, and later release a load of logs. The grapple assembly generally includes a grapple head that is actuated through various positions, and a hydraulic motor for rotating the grapple head. The hydraulic motor is utilized to position the grapple head at a proper orientation with respect to a load of logs to be hauled. This allows an operator of the skidder to approach the logs from any direction in order to grab the logs and secure them in a grasping configuration of the grapple head. Hauling is typically accomplished by grasping a load of logs at one end and dragging the logs behind the skidder.

When the grapple head is in a grasping configuration, i.e., logs are being carried or dragged by the grapple head, a tremendous torque may act on the grapple assembly when the skidder turns and the logs rotate relative to the machine or resist turning of the skidder. Specifically, when turning the skidder, the logs lag in the turn thereby twisting the grapple head and rotating the hydraulic motor. This force creates a torque against the motor and forces it to act as a pump. This can result in cavitation which can lead to reduced motor life and other stresses on hydraulic circuitry.

To account for this, pressure relief systems have been devised to flush or release pressure within a hydraulic system. For example, U.S. Pat. No. 5,018,935 includes two spring biased pressure relief valves. A first valve is hydraulically coupled to a first supply/return line of a hydraulic motor and a second valve is hydraulically coupled to a second supply/return line of the hydraulic motor. When pressure becomes too high in either the first or the second supply/return line, the valve coupled to the supply/return line will be hydraulically actuated to open a bypass line to relieve pressure to the hydraulic motor. Since an adequate amount of pressure will be required to operate the hydraulic motor, this reference only provides relief as described above when pressure within one of the supply/return lines reaches an overpressurized state. In fact, the threshold at which the relief valves are set to actuate may be so high, to allow for normal operation of the hydraulic motor, that cavitation could occur before either of the relief valves are actuated.

The present disclosure is directed to one or more of the problems set forth above.

SUMMARY OF THE INVENTION

In one aspect, a machine includes a chassis and a boom assembly mounted on the chassis. The boom assembly is movable relative to the chassis. The machine further includes a grapple assembly suspended from the boom assembly. The grapple assembly comprises a grapple head fluidly connected to a first hydraulic circuit for actuating the grapple head to a grasping configuration, and a hydraulic motor fluidly connected to a second hydraulic circuit for rotating the grapple head. The second hydraulic circuit includes a bypass valve. The bypass valve has a first position configured to block a fluid flow between a first port of the hydraulic motor and a second port of the hydraulic motor. The bypass valve also has a second position configured to allow a fluid flow between the first port of the hydraulic motor and the second port of the hydraulic motor. The bypass valve is movable in response to a condition of the first hydraulic circuit.

In another aspect, a method of operating a machine with a grapple head fluidly connected to a first hydraulic circuit for grasping a load and a hydraulic motor fluidly connected to a second hydraulic circuit includes a step of coupling the grapple head to the hydraulic motor for rotational movement thereof. The hydraulic motor rotates the grapple head in a first direction about an axis or in a second, opposite direction about the axis. The method further includes a step of actuating the grapple head to a grasping configuration. The method further includes a step of allowing the grapple head to rotate freely about the axis in response to a condition of the first hydraulic circuit, communicated, for example, either hydraulically or electrically.

In still another aspect, a grapple assembly includes a grapple head fluidly connected to a first hydraulic circuit. The grapple assembly further includes an actuator for actuating the grapple head to a grasping configuration via the first hydraulic circuit. The grapple assembly further includes a hydraulic motor fluidly connected to a second hydraulic circuit for rotating the grapple head about an axis. The grapple assembly further includes an electronic controller configured to allow the grapple head to rotate freely about the axis when the grapple head is in the grasping configuration.

DETAILED DESCRIPTION

Figure 1:
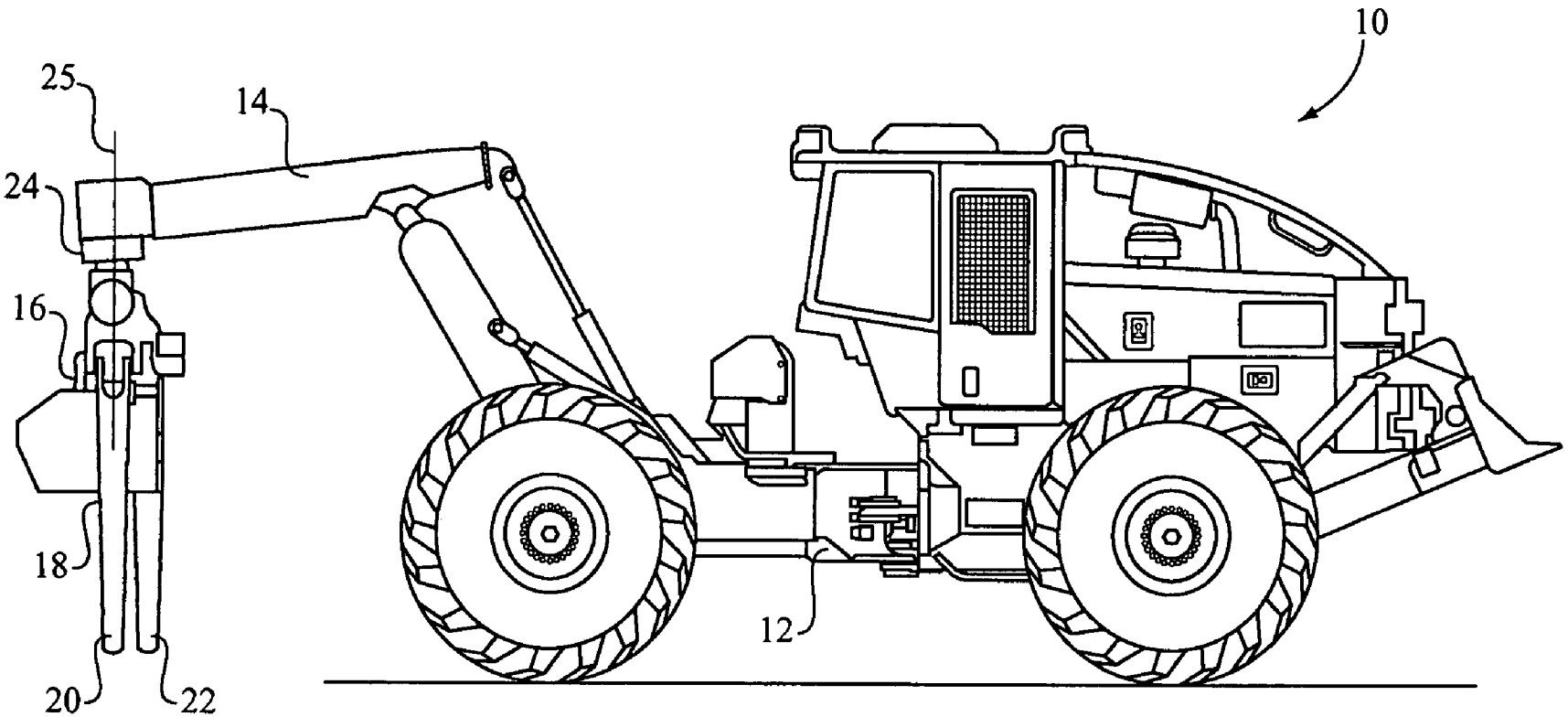
FIG. 1 is a side diagrammatic view of a machine having a grapple assembly according to the present disclosure.

An exemplary embodiment of a machine 10 is shown generally in FIG. 1. The machine 10 may be a grapple skidder, wheeled or track-type, or any other vehicle that utilizes a rotating grapple assembly. In the illustrated embodiment, grapple skidder 10 comprises a chassis 12, such as, for example, an articulated frame chassis or other chassis known in the art, having a boom assembly 14 mounted on the chassis 12. The boom assembly 14 is movable with respect to the chassis 12. For instance, the boom assembly 14 may be movable within a vertical plane. The grapple skidder 10 further includes a grapple assembly 16.

The grapple assembly 16 generally includes a grapple head 18 including a pair of opposed grapple tongs, 20 and 22. Grapple head 18 is hydraulically actuated, namely grapple tongs 20 and 22 are driven toward one another or away from one another, in order to secure or release a load of logs. The grapple assembly 16 further includes a hydraulic motor 24 for rotating the grapple head 18 in a first direction about an axis 25 or in a second, opposite direction about the axis 25. The hydraulic motor 24 therefore facilitates proper orientation of the grapple head 18 with respect to a load of logs.

Figure 2:
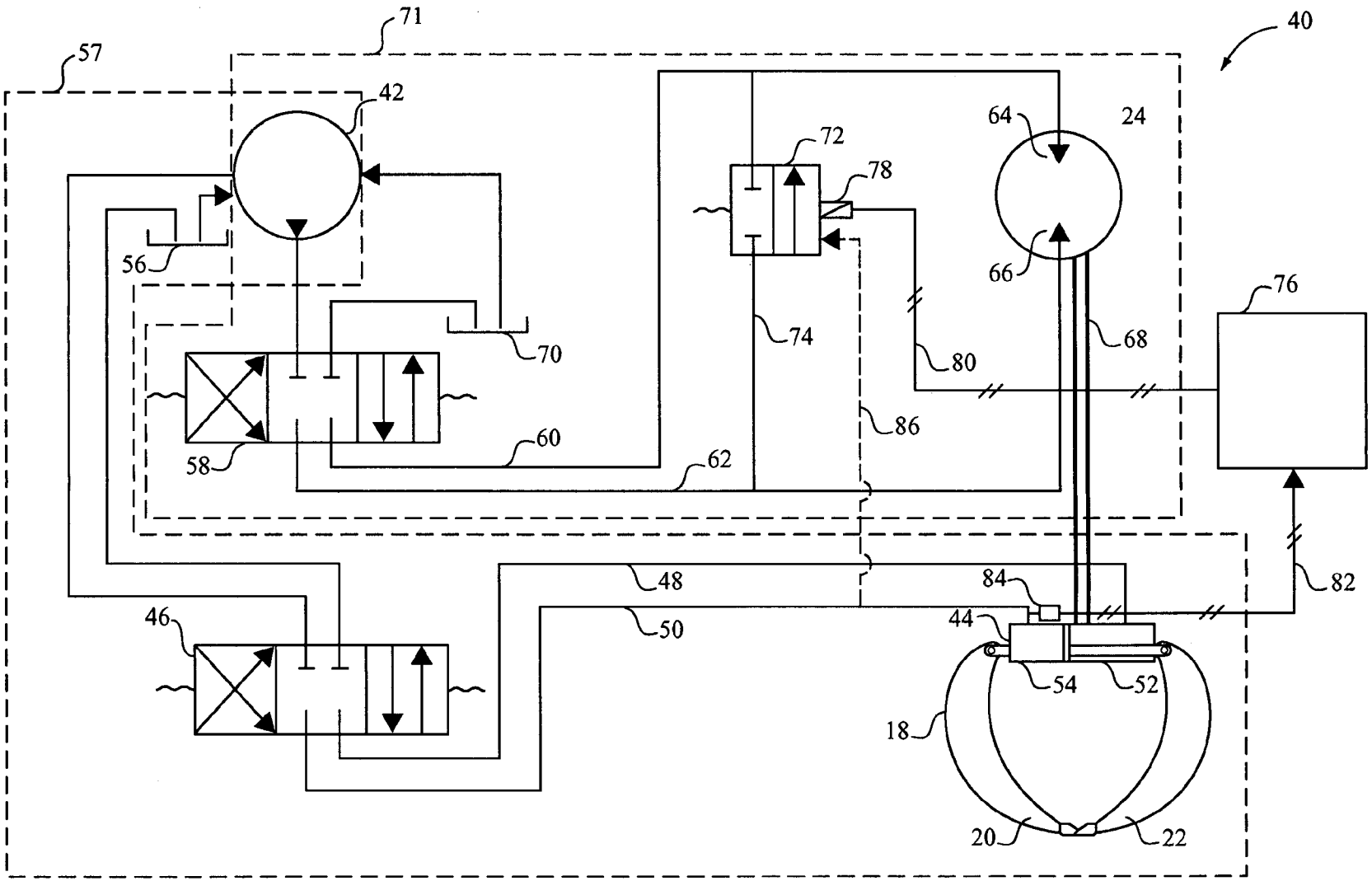
FIG. 2 is a electrical, hydraulic, and mechanical schematic of a hydraulic system of the machine of FIG. 1.

FIG. 2 illustrates construction details of the grapple skidder 10 in schematic form, shown generally at 40. Pump 42 is a hydraulic pump used to control a grapple cylinder 44 of the grapple assembly 16. A control valve 46 controls the flow of hydraulic fluid from the pump 42 to the grapple cylinder 44 through hydraulic lines 48 and 50. Hydraulic line 48 is connected to the rod end 52 of the grapple cylinder 44 and hydraulic line 50 is connected to the base end 54 of the grapple cylinder 44. When the control valve 46 is in a neutral position, the position of the grapple tongs (20, 22) remains constant. When the control valve 46 is positioned to the right of the neutral position, hydraulic fluid is pumped through hydraulic line 48 to the rod end 52 of the grapple cylinder 44 to move grapple tongs 20 and 22 away from one another, placing the grapple head 18 in an open position to receive logs. When the control valve 46 is positioned to the left of the neutral position, hydraulic fluid is pumped through hydraulic line 50 to the base end 54 of the grapple cylinder 44 to move grapple tongs 20 and 22 toward one another, placing the grapple head 18 in a grasping configuration to haul logs. Discharge hydraulic fluid may flow to a reservoir 56, from where pump 42 may receive and later pressurize said hydraulic fluid. The hydraulic circuit defined by the fluid flow between the pump 42 and the grapple head 18 may constitute a first hydraulic circuit 57. Although grapple assembly 16 is shown having one grapple cylinder 44 for controlling actuation of the grapple head 18, those skilled in the art will appreciate that more than one grapple cylinder may be used. For example, one grapple cylinder may be provided for hydraulically controlling each of the two tongs 20 and 22 of the grapple head 18.

Pump 42 may also drive the hydraulic motor 24. However, a different pump may be used, if desired, to drive the hydraulic motor 24. A rotational control valve 58 controls the flow of hydraulic fluid from the pump 42 to the hydraulic motor 24 through hydraulic lines 60 and 62. Hydraulic line 60 is connected to a first port 64 of the motor 24 and hydraulic line 62 is connected to a second port 66 of the motor 24. When the rotational control valve 58 is positioned to the right of the neutral position, hydraulic fluid is pumped through hydraulic line 60 to the first side 64 of the hydraulic motor 24 to rotate the hydraulic motor 24 in a first direction. When the rotational control valve 58 is positioned to the left of the neutral position, hydraulic fluid is pumped through hydraulic line 62 to the second side 66 of the hydraulic motor 24 to rotate the hydraulic motor 24 in a second direction. The hydraulic motor 24 may be coupled to and drive rotation of the grapple head 18 via a shaft 68. The hydraulic motor 24 may, alternatively, be a high power motor and gear reduction means may be necessary to provide a useable speed to the shaft 68. Discharge hydraulic fluid may flow to a reservoir 70, from where pump 42 may receive and later pressurize said hydraulic fluid. The hydraulic circuit defined by the fluid flow between the pump 42 and the hydraulic motor 24 may constitute a second hydraulic circuit 71.

The second hydraulic circuit 71, defined above, may also include a bypass valve 72. In operation, bypass valve 72 is biased to a closed position (as shown) and prevents fluid flow through a bypass line 74. When, however, bypass valve 72 is moved to an open position (not shown) fluid flow is allowed through the bypass line 74. This open position bypasses the motor 24 and allows fluid to flow freely from the first port 64 of the hydraulic motor 24 to the second port 66 of the hydraulic motor 24 and from the second port 66 of hydraulic the motor 24 to the first port 64 of the hydraulic motor 24. This, in turn, allows the hydraulic motor 24 and the grapple head 18 to "rotate freely," resisted only by pushing fluid between the first port 64 and the second port 66 of the hydraulic motor 24, and without a substantial pressure differential between the ports 64 and 66.

The grapple skidder 10 may also include an electronic controller 76. In its most basic version, the electronic controller is of standard design and may include a processor, a memory, and an input/output circuit. The memory may include instructions for controlling operation of the electronic controller 76. The input/output circuit may receive and send communications to and from sensors and/or additional controllers throughout grapple skidder 10, and the processor may carry out instructions initiated internally or externally of the electronic controller 76.

The electronic controller 76 may control an electronic actuator 78, such as, for example, a solenoid, which actuates the bypass valve 72 to an open position via an electronic control signal 80. The electronic controller 76 may initiate this electronic control signal 80 based on a command from an operator of the grapple skidder 10 or the electronic control signal 80 may be initiated automatically based on data received via an electronic signal 82 from a sensor 84, or an alternative position sensor (not shown).

The sensor 84 may be configured to sense a pressure level within hydraulic line 50. Alternatively, the sensor 84 may be configured to sense a pressure level within hydraulic line 48. The sensor 84 is in communication with the electronic controller 76 and transmits the sensed pressure level within hydraulic line 50 or, alternatively, hydraulic line 48 to the electronic controller 76 via the electronic signal 82. The electronic controller determines whether the grapple head 18 is in an open position, i.e., not carrying logs, or a grasping configuration, i.e., carrying logs based on the received pressure level. If the electronic controller 76 determines that there is a high pressure level within the hydraulic line 50 or, alternatively, there is a low pressure level in hydraulic 48, the electronic controller may conclude the grapple head 18 is in a grasping configuration, i.e., carrying logs. In response, the electronic controller 76 may move the electronic actuator 78 to an open position via the electronic control signal 80. This allows a fluid connection between the first port 64 of the hydraulic motor 24 and the second port 66 of the hydraulic motor 64 via the bypass line 74. As a result, the hydraulic motor 24 and the grapple head 18 driven by the motor 24 are allowed to "rotate freely." In this embodiment, an override command may be provided for an operator of the grapple skidder 10 to effectively override the electronic control signal 80, if deemed necessary. When initiated, the override command may simply prevent the electronic controller 76 from moving the electronic actuator 78 via the electronic control signal 80.

Alternatively, the bypass valve 72 may be actuated hydraulically via a hydraulic line 86 coupled to hydraulic line 50. A high pressure within hydraulic line 50, i.e., when the grapple head 18 is in a grasping configuration, may hydraulically actuate the bypass valve 72 to an open position. Again, this allows a fluid connection between the first port 64 of the hydraulic motor 24 and the second port 66 of the hydraulic motor 64 via the bypass line 74.

In yet another embodiment, rather than including the bypass valve 72 previously described, the hydraulic motor 24 could be physically disengaged from the grapple head 18 when the grapple head is in a grasping configuration. This may be accomplished by providing a gear coupling or a clutch-type mechanism between the hydraulic motor 24 and the grapple assembly 16. This alternative is analogous to how an ignition system works in an automobile. In that context, a starter motor includes a small gear attached to an end of the motor. When the starter motor is activated, the small gear is actuated into engagement with a larger gear attached to the engine. When the engine starts to spin faster than the starter motor, a clutch automatically retracts or disengages the small gear of the starter motor from the large gear of the engine. In a similar fashion, the hydraulic motor 24 could be disengaged from the grapple head 18 when an operator initiates the action or, alternatively, when a grasping configuration of the grapple head 18 is detected as described above.

INDUSTRIAL APPLICABILITY

A typical grapple assembly 16 for a grapple skidder 10 includes a grapple head 18 comprising two grapple tongs, 20 and 22. Grapple head 18 is hydraulically actuated, namely grapple tongs 20 and 22 are driven toward one another or away from one another, in order to secure or release a load of logs. The grapple assembly 16 further includes a hydraulic motor 24 for rotating the grapple head 18. The hydraulic motor 24 therefore facilitates proper orientation of the grapple head 18 with respect to a load of logs.

When the grapple head 18 is in a grasping configuration, i.e., logs are being carried or dragged by the grapple head, a tremendous force will act on the grapple assembly when the skidder 10 turns and the logs rotate relative to the skidder. This force creates a torque against the hydraulic motor 76 and forces it to act as a pump. This can result in cavitation which can lead to reduced motor and valve life. When the grapple head 18 is in a grasping configuration, the method of disconnecting the hydraulic motor according to the present disclosure may be implemented to prevent this from occurring.

Figure 3:
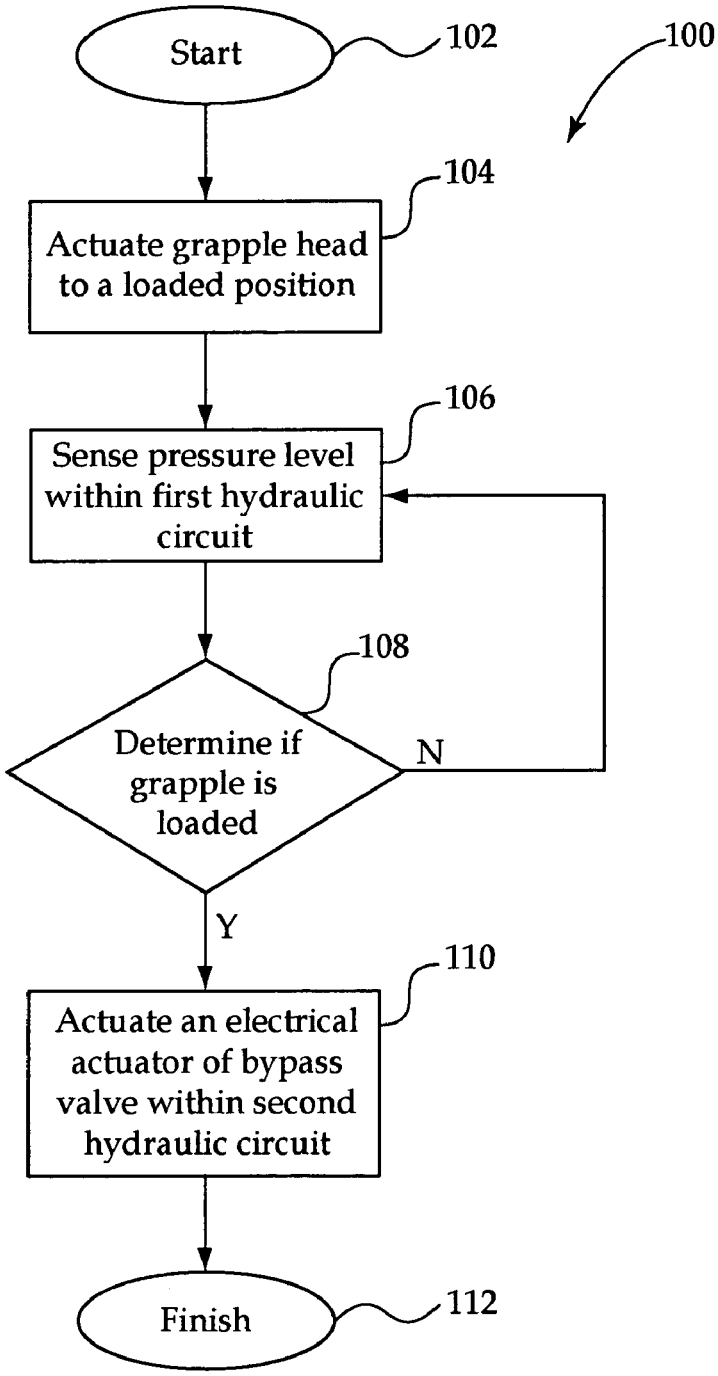
FIG. 3 is a flow chart of one embodiment of a method of disconnecting a hydraulic motor from use in a grapple assembly according to the present disclosure.

Turning to FIG. 3, there is shown a flow chart 100 representing an exemplary method of disconnecting a hydraulic motor from use in a grapple assembly according to the present disclosure. The method begins at a START, Box 102. From Box 102, the method may proceed to Box 104, which includes the step of actuating the grapple head 18 to a grasping configuration. From Box 102, the method may proceed to Box 106, wherein the sensor 84 senses a pressure level within hydraulic line 50. Instantaneously, the electronic controller 76 receives data representing the pressure level from the sensor 84 via the electronic signal 82. At Box 108, the electronic controller 76 determines whether the grapple head 18 is in a grasping configuration based on the data received from the sensor 84. If the electronic controller 76 determines the grapple head 18 is in a grasping configuration, the method proceeds to Box 110. If, however, the electronic controller 76 determines the grapple head 18 is in an open position, the method returns to Box 106, wherein a pressure level within the hydraulic line 50 is sensed by sensor 84 and communicated to electronic controller 76.

At Box 110, in response to the determination that the grapple is in a grasping configuration, the electronic controller 76 sends a signal via electronic signal 80 to actuate the electrical actuator 78 of the bypass valve 72. This, in turn, allows a fluid connection between the first port 64 of the hydraulic motor 24 and the second port 66 of the hydraulic motor 64 via the bypass line 74. As a result, the hydraulic motor 24 and the grapple head 18 driven by the motor 24 are allowed to "freely rotate." Following actuation of the bypass valve 72, the method may proceed to a FINISH, Box 112.

The present disclosure is advantageous because it allows the grapple head of a skidder to rotate freely when the grapple head is in a grasping configuration. Specifically, when it is detected that the grapple head is in a grasping configuration, the hydraulic motor driving rotation of the grapple head can be hydraulically disconnected so that both the hydraulic motor and the grapple head rotate freely. This avoids situations where the hydraulic motor is backdriven and forced to act like a pump, thereby preventing cavitation and leading to increased motor life.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

What is claimed is:

1. A machine, comprising:

a chassis;

a boom assembly mounted on the chassis, the boom assembly being movable relative to the chassis; and a grapple assembly suspended from the boom assembly, the grapple assembly including a grapple head fluidly connected to a hydraulic pump along a first hydraulic circuit for actuating the grapple head to a grasping configuration, the grapple assembly further including a hydraulic motor fluidly connected to the hydraulic pump along a second hydraulic circuit for rotating the grapple head using a shaft;

the second hydraulic circuit including a bypass valve having a first position configured to block a fluid flow between a first port of the hydraulic motor and a second port of the hydraulic motor, and a second position configured to allow a fluid flow between the first port of the hydraulic motor and the second port of the hydraulic motor, wherein the bypass valve is movable in response to a pressure level within the first hydraulic circuit.

2. The machine of claim 1, further comprising an electronic controller in communication with an electrical actuator coupled to the bypass valve, the electrical actuator configured to move the bypass valve from the first position to the second position.

3. The machine of claim 2, further comprising a sensor in communication with the electronic controller, the sensor configured to sense the pressure level within the first hydraulic circuit, wherein a high pressure level indicates the grasping configuration of the grapple head and a low pressure level indicates an open configuration of the grapple head.

4. The machine of claim 3, wherein the bypass valve is biased toward the first position.

5. A machine, comprising:

a chassis;

a boom assembly mounted on the chassis, the boom assembly being movable relative to the chassis;

a grapple assembly suspended from the boom assembly, the grapple assembly including a grapple head fluidly connected to a hydraulic pump along a first hydraulic circuit for actuating the grapple head to a grasping configuration, the grapple assembly further including a hydraulic motor fluidly connected to the hydraulic pump along a second hydraulic circuit for rotating the grapple head using a shaft;

the second hydraulic circuit including a bypass valve having a first position configured to block a fluid flow between a first port of the hydraulic motor and a second port of the hydraulic motor, and a second position configured to allow a fluid flow between the first port of the hydraulic motor and the second port of the hydraulic motor, wherein the bypass valve is biased toward the first position;

a sensor in communication with an electronic controller, the sensor configured to sense a pressure level within the first hydraulic circuit, wherein a high pressure level indicates the grasping configuration of the grapple head and a low pressure level indicates an open configuration of the grapple head; and the electronic controller being in communication with an electrical actuator coupled to the bypass valve, wherein the electronic controller is configured to actuate the electrical actuator to move the bypass valve to the second position if the electronic controller detects the grasping configuration of the grapple head.

6. A machine, comprising:

a chassis;

a boom assembly mounted on the chassis, the boom assembly being movable relative to the chassis; and a grapple assembly suspended from the boom assembly, the grapple assembly including a grapple head fluidly connected to a hydraulic pump along a first hydraulic circuit for actuating the grapple head to a grasping configuration, the grapple assembly further including a hydraulic motor fluidly connected to the hydraulic pump along a second hydraulic circuit for rotating the grapple head using a shaft;

the second hydraulic circuit including a bypass valve having a first position configured to block a fluid flow between a first port of the hydraulic motor and a second port of the hydraulic motor, and a second position configured to allow a fluid flow between the first port of the hydraulic motor and the second port of the hydraulic motor;

the bypass valve including a hydraulic actuator coupled to the first hydraulic circuit, wherein the hydraulic actuator is configured to move the bypass valve from the first position to the second position in response to a high pressure level within the first hydraulic circuit, wherein the high pressure level indicates the grasping configuration of the grapple head.

7. The machine of claim 1, wherein the second hydraulic circuit includes a rotator control valve, the rotator control valve having a first position configured to allow a fluid flow effecting a first rotational direction from the hydraulic motor and a second position configured to allow a fluid flow effecting a second rotational direction from the hydraulic motor, wherein the bypass valve is hydraulically positioned between the rotator control valve and the hydraulic motor.

8. A method of operating a machine with a grapple assembly, the grapple assembly including a grapple head fluidly connected to a hydraulic pump along a first hydraulic circuit, and a hydraulic motor fluidly connected to the hydraulic pump along a second hydraulic circuit, the method comprising:

coupling the grapple head to the hydraulic motor, wherein the hydraulic motor rotates the grapple head in a first direction about an axis or in a second direction about the axis;

actuating the grapple head to a grasping configuration; and allowing the grapple head to rotate freely about the axis in response to detecting a high pressure level within the first hydraulic circuit, the high pressure level being indicative of the grasping configuration.

9. The method of claim 8, wherein the allowing step includes:

fluidly connecting a first port of the hydraulic motor and a second port of the hydraulic motor via a bypass valve.

10. A method of operating a machine with a grapple assembly, the grapple assembly including a grapple head fluidly connected to a hydraulic pump along a first hydraulic circuit and a hydraulic motor fluidly connected to the hydraulic pump along a second hydraulic circuit, the method comprising:

coupling the grapple head to the hydraulic motor, wherein the hydraulic motor rotates the grapple head in a first direction about an axis or in a second direction about the axis;

actuating the grapple head to a grasping configuration;

actuating a hydraulic actuator with a fluid pressure within the first hydraulic circuit to move a bypass valve of the second hydraulic circuit to an open position; and fluidly connecting a first port of the hydraulic motor and a second port of the hydraulic motor as a result of the open position of the bypass valve to allow the grapple head to rotate freely about the axis.

11. The method of claim 9, wherein the fluidly connecting step includes:

actuating an electrical actuator to move the bypass valve to an open position.

12. The method of claim 8, wherein the allowing step includes:

sensing a pressure level within the first hydraulic circuit using a sensor; and communicating the pressure level to an electronic controller, wherein the electronic controller is configured to a determine the grasping configuration of the grapple head based on the sensed pressure level.

13. The method of claim 12, further comprising:

actuating an electrical actuator to move the bypass valve to an open position in response to the electronic controller determining the grasping configuration of the grapple head.

14. A grapple assembly, comprising:

a grapple head fluidly connected to a hydraulic pump alone a first hydraulic circuit;

an actuator for actuating the grapple head to a grasping configuration using the first hydraulic circuit;

a hydraulic motor for rotating the grapple head about an axis, the hydraulic motor fluidly connected to the hydraulic pump along a second hydraulic circuit; and an electronic controller configured to allow the grapple head to rotate freely about the axis by actuating a bypass valve of the second hydraulic circuit when the electronic controller detects the grasping configuration.

15. The grapple assembly of claim 14, wherein the bypass valve includes a first position configured to block a fluid flow between a first port of the hydraulic motor and a second port of the hydraulic motor, and a second position configured to allow a fluid flow between the first port of the hydraulic motor and the second port of the hydraulic motor.

16. The grapple assembly of claim 15, further comprising:

an electrical actuator coupled to the bypass valve, the electrical actuator configured to move the bypass valve from the first position to the second position when the electronic controller detects the grasping configuration.

17. The grapple assembly of claim 14, further comprising:

a sensor in communication with the electronic controller, the sensor configured to sense a pressure level within the first hydraulic circuit, wherein a high pressure level indicates the grasping configuration of the grapple head.

* * * * *